US009364305B2

(12) United States Patent
Lynch

(10) Patent No.: US 9,364,305 B2
(45) Date of Patent: Jun. 14, 2016

(54) ANIMAL DENTAL CLEANING DEVICE

(71) Applicant: Ky S Lynch, Morrison, CO (US)

(72) Inventor: Ky S Lynch, Morrison, CO (US)

( * ) Notice: Subject to any disclaimer, the term of this patent is extended or adjusted under 35 U.S.C. 154(b) by 373 days.

(21) Appl. No.: 13/898,278

(22) Filed: May 20, 2013

(65) Prior Publication Data

US 2014/0342298 A1 Nov. 20, 2014

(51) Int. Cl.
*A61D 5/00* (2006.01)

(52) U.S. Cl.
CPC ..... *A61D 5/00* (2013.01); *A46B 2200/1086* (2013.01)

(58) Field of Classification Search
CPC ..... A61D 5/00; A46B 15/0032; A46B 2200/1086; A46B 15/00; A46B 15/0075; A46B 9/06
USPC ..... 433/1, 216; 119/709, 710; 15/106, 15/104.94, 209.1, 210.1, 118, 223, 225; 300/21; 604/71
See application file for complete search history.

(56) References Cited

U.S. PATENT DOCUMENTS

| | | | | |
|---|---|---|---|---|
| 3,853,412 | A | 12/1974 | Griffin | |
| 4,924,811 | A | 5/1990 | Axelrod | |
| 5,027,463 | A * | 7/1991 | Daub | 15/22.1 |
| 5,263,436 | A | 11/1993 | Axelrod | |
| 5,329,881 | A | 7/1994 | O'Rourke | |
| 5,669,097 | A | 9/1997 | Klinkhammer | |
| 5,944,516 | A | 8/1999 | Deshaies | |
| 6,141,815 | A | 11/2000 | Harrison et al. | |
| 6,405,681 | B1 | 6/2002 | Ward | |
| 6,474,268 | B1 | 11/2002 | Suchowski et al. | |
| 6,582,224 | B1 | 6/2003 | Lilien et al. | |
| 6,673,857 | B1 * | 1/2004 | Knoll et al. | 524/315 |
| 6,739,287 | B1 | 5/2004 | Sarantis | |
| 7,490,579 | B2 | 2/2009 | Axelrod | |
| 2002/0083539 | A1 | 7/2002 | Bella | |
| 2003/0108846 | A1 | 6/2003 | Hoertsch | |
| 2007/0101946 | A1 | 5/2007 | Penny | |
| 2008/0201881 | A1 | 8/2008 | Dunn et al. | |
| 2010/0326368 | A1 | 12/2010 | Tsengas | |
| 2011/0290197 | A1 | 12/2011 | Koo et al. | |
| 2012/0160180 | A1 | 6/2012 | Townsend et al. | |
| 2012/0279460 | A1 | 11/2012 | Pang et al. | |

FOREIGN PATENT DOCUMENTS

| | | | |
|---|---|---|---|
| WO | 2007149963 | A3 | 12/2007 |

* cited by examiner

*Primary Examiner* — Cris L Rodriguez
*Assistant Examiner* — Mirayda A Aponte
(74) *Attorney, Agent, or Firm* — James M. Weatherly; Cochran Freund & Young LLC

(57) ABSTRACT

An animal dental cleaning device for cleaning the teeth of a domesticated or non-domesticated animal while the animal is participating in a pulling game with another animal or person, such as tug-of-war, is provided. Methods for cleaning teeth of animals using an animal dental cleaning device while the animal is participating in a pulling game with another animal or person are also provided.

16 Claims, 7 Drawing Sheets

ANIMAL DENTAL CLEANING DEVICE

BACKGROUND

Maintaining good dental hygiene is important for domesticated animals, such as dogs and cats as well as non-domesticated animals. Periodontal disease, also known as gum disease and other dental maladies can be a common problem for domesticated animals from the buildup of tartar on the teeth. Gum disease from infected gums can easily transmit bacteria to the blood stream, causing serious illness in a wide variety of domesticated animals.

The foregoing examples of related art and limitations related therewith are intended to be illustrative and not exclusive, and they do not imply any limitations on the inventions described herein. Other limitations of the related art will become apparent to those skilled in the art upon a reading of the specification and a study of the drawings.

SUMMARY

The following embodiments and aspects thereof are described and illustrated in conjunction with systems, tools and methods, which are meant to be exemplary and illustrative, not limiting in scope.

An embodiment of the present invention comprises an animal dental cleaning device, comprising an actuator element comprising at least one row of a first set of bristles attached to the actuator element, wherein the first set of bristles extend in a first direction from the actuator element; at least one row of a second set of bristles attached to the actuator element, wherein the second set of bristles extend in a second direction from the actuator element; a connector wherein the connector is attached to the actuator element; an outer shell comprising at least one first bristle opening; at least one second bristle opening; and a connector opening; wherein a portion of the actuator element is configured to interface with the outer shell, wherein the at least one first bristle opening aligns with the first set of bristles extending in a first direction from the actuator element; wherein the at least one second bristle opening aligns with the second set of bristles extending in a second direction from the actuator element; and wherein the connector aligns with the connector opening.

In an additional embodiment, a method of cleaning the teeth of an animal is provided comprising: providing an animal dental cleaning device comprising an actuator element, and an outer shell with bristles protruding through bristle openings in the outer shell; causing an animal to bite on the outer shell of the animal dental cleaning device, thereby causing the bristles protruding through openings in the outer shell to make contact with the teeth of the animal; causing a second animal or person to grasp a handle of the actuator element, wherein the second animal or person pulls the actuator element in the opposite direction from the animal biting the outer shell; and causing the bristles of the animal dental cleaning device to brush the teeth of the animal biting the outer shell of the animal dental cleaning device.

In addition to the embodiments described above, further aspects and embodiments will become apparent by reference to the drawings and by study of the following descriptions, any one or all of which are within the invention. The summary above is a list of example implementations, not a limiting statement of the scope of the invention.

BRIEF DESCRIPTION OF THE FIGURES

The accompanying drawings, which are incorporated herein and form a part of the specification, illustrate some, but not the only or exclusive, example embodiments and/or features. It is intended that the embodiments and figures disclosed herein are to be considered illustrative rather than limiting.

DETAILED DESCRIPTION

One or more embodiments of the present disclosure provide an animal dental cleaning device, which allows for the cleaning of a domesticated or non-domesticated animal's teeth while playing with another animal or a human. The device may be used to clean the teeth of a wide range of animals, including but not limited to, dogs, cats, horses, cattle, ox, goats, sheep, donkeys, mules, camels, llamas, alpacas, ferrets, pigs, and gerbils, as well as non-domesticated animals such as but not limited to lions, deer, buffalo, tigers, zebras, bears, and kangaroos. The device of the present disclosure has the added benefit of cleaning the teeth of various types of animals without the need for sedation of the animal. As will be discussed in more detail, the animal dental cleaning device functions by providing an outer shell, which provides a surface area for an animal to bite. As the animal bites on the outer shell of the animal dental cleaning device, bristles protruding from the device make contact with the teeth of the animal. The bristles protruding through elongated openings in the outer shell are attached to an actuator element. As a person or another animal grasps a handle portion of the actuator element and begin to pull, the outer shell within the animal's mouth does not move but the bristles attached to the actuator element slide in the direction of the person pulling the hand of the actuator element. By pulling and releasing the actuator element, the bristles slide back and forth within the openings in the outer shell, causing the bristles contacting the animal's teeth to brush and rub against the animal's teeth.

Figure 1:
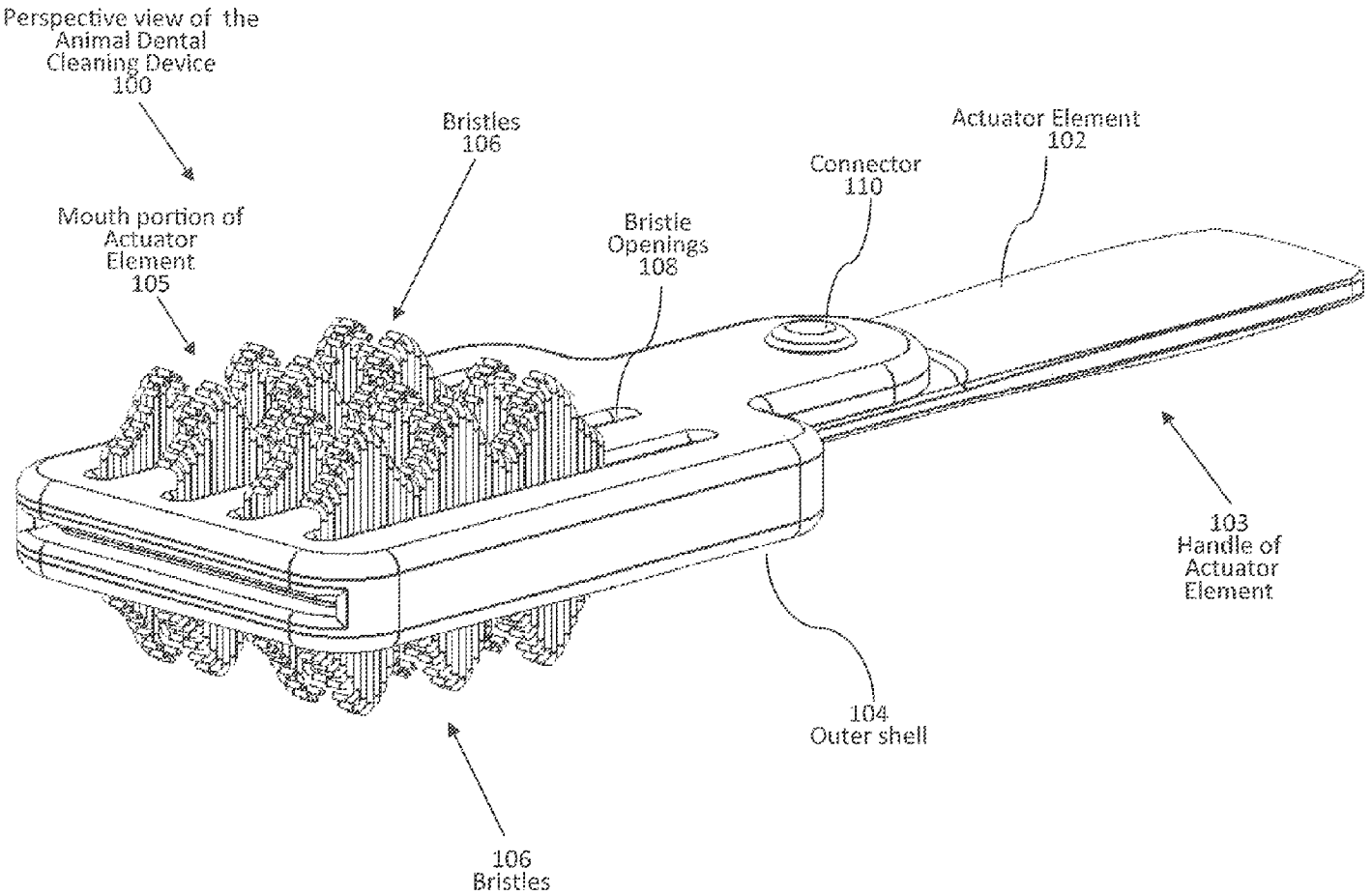
FIG. 1 is a perspective view of an animal dental cleaning device.

As shown in FIG. 1, an embodiment of the present disclosure provides an animal dental cleaning device 100 comprising an actuator element 102 where one end of the actuator element 102 forms a handle of the actuator element 103 while the opposite end of the actuator element 102 forms the mouth portion of the actuator element 105. The mouth portion of the actuator element 105 is housed or embedded inside a hollow outer shell 104. One or more rows of bristles 106 are attached or inserted into rows of holes in the mouth portion of the actuator 105, where a first set of rows of bristles 106 extend outwardly in one direction from the mouth portion of the actuator element 105 and a second set of bristles extend outwardly in a second direction from the mouth portion of the actuator element 105. In an example embodiment, the first set of bristles 106 extend 90° perpendicular from the mouth portion of the actuator element 105 while the second set of bristles extend 180° opposite of the first set of bristles. As will be discussed in a more detail in FIGS. 5*a*, 5*b*, 5*c*, 5*d*, 5*e* and 5*f* a variety of configurations and forms of bristles may be used in the present invention. In the example device 100 shown in FIG. 1, a sine wave bristles is illustrated however, it should be understood that this description is applicable to any such device with other bristle configurations, as will be understood by one skilled in the art, once they understand the principles of this invention.

As shown in FIG. 1, the mouth portion of the actuator element 105 is housed or embedded in a hollow outer shell 104. The hollow outer shell 104 has a broad, flattened top and a bottom portion that provides a platform for an animal to bite the animal dental cleaning device 100. The outer shell 104 has one or more bristle openings 108 located on the flattened top and bottom portions of the outer shell 104. The bristle openings 108 correspond to the location of the one or more rows of bristles 106 formed in the mouth portion of the actuator element 105. The bristle openings 108 of the outer shell 104 allow for the bristles 106 on the actuator element 102 to protrude through the outer shell 104. In the example shown in FIG. 1, four bristle openings 108 are illustrated, however, it should be understood that this description is applicable to any number of bristle opening 108 configurations, including one, two, three, five, six or more as will be understood by one skilled in the art, once they understand the principles of this invention.

Figure 3:
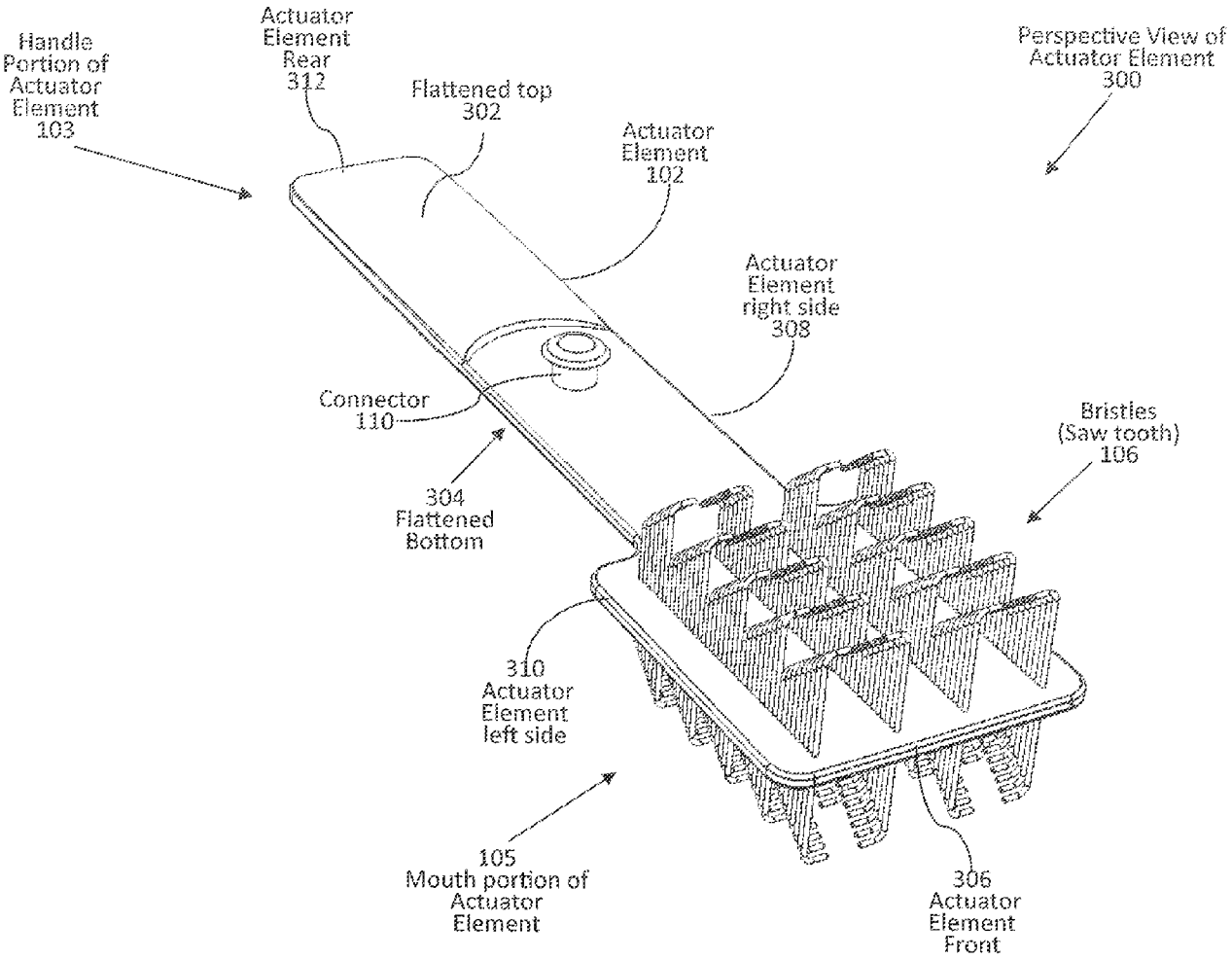
FIG. 3 is a perspective view of the actuator element with bristles (saw tooth configuration).

As further shown in FIG. 1 and further described in FIG. 3, the actuator element 102 is connected to the outer shell 104 by means of a connector 110. The connector 110 is comprised of an elastic rod body that extends upwardly from the actuator element 102 through a connector opening (not shown in FIG. 1) in the outer shell 104 to a top cap or mount on the connector 110 that is configured to interface with the outer shell 104. The connector 110 provides a rigid attachment point between the actuator element 102 and the outer shell 104, while also allowing the actuator element 102 to slide longitudinally within the outer shell 104, allowing the bristles 106 attached to the actuator element 102 to slide longitudinally within the bristle openings 108.

Figures 2A, 2B:
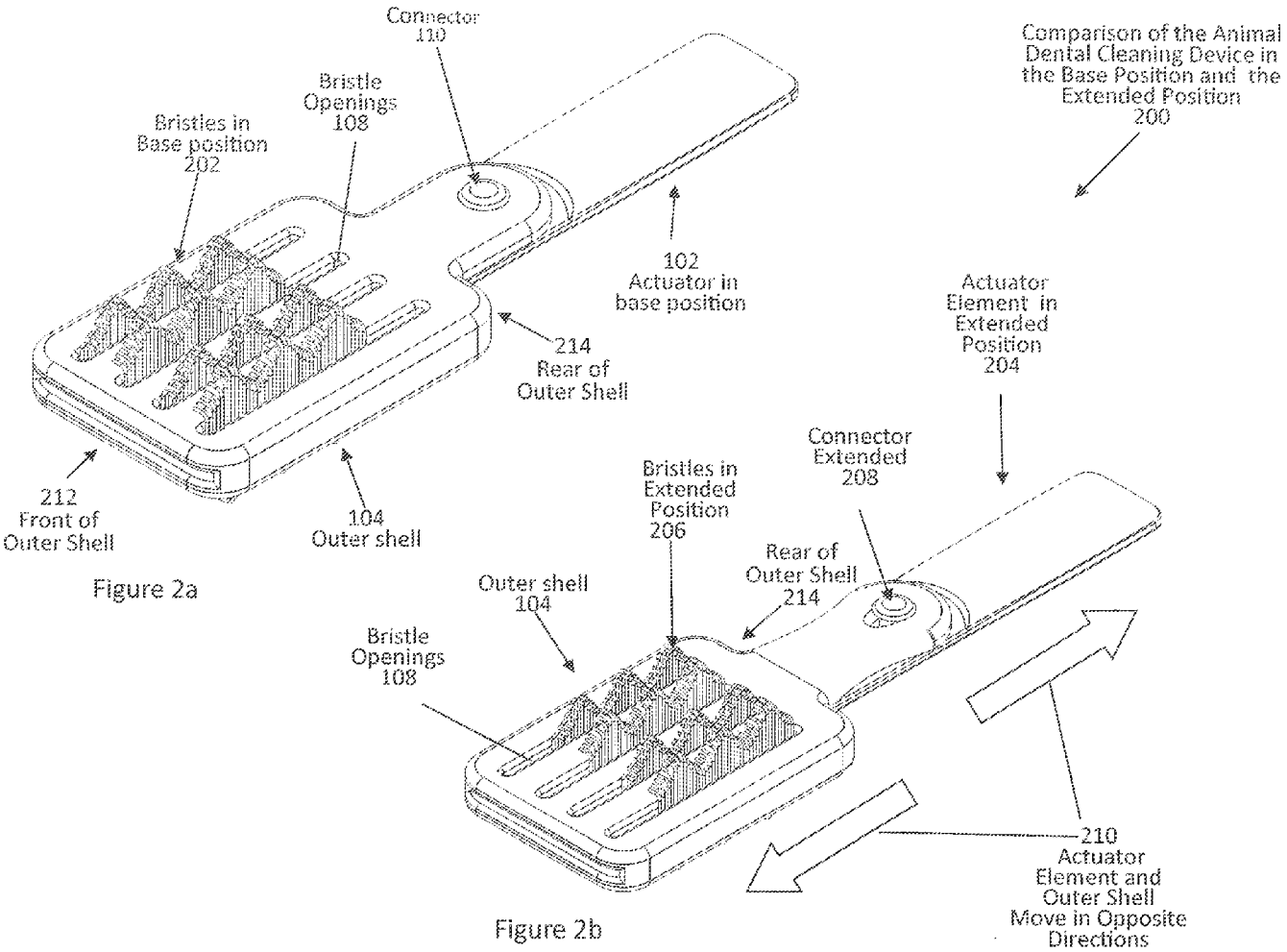
FIG. 2*a* is a perspective view showing an animal dental cleaning device in a base position.
FIG. 2*b* is a perspective view showing an animal dental cleaning device in an extended position.

FIG. 2*a* and FIG. 2*b* provides an example comparison of an animal dental cleaning device in the base position and in the extended position 200. As shown in FIG. 2*a*, the actuator element 102 and the connector 110 are situated in a base position within the outer shell 104. As shown in FIG. 2*a*, the bristles are also located in a base position, where the bristles base position 202 protrude through the bristle openings 108 at the front 212 of the outer shell 104.

As shown in FIG. 2*b*, the animal dental cleaning device is shown with the actuator element and the outer shell extending in opposite directions 210. As shown in FIG. 2*b*, when an animal bites down on the outer shell 104 and a second animal or person grasps and pulls on the handle of the actuator element in the opposite direction of the outer shell 104, the pulling action causes the actuator element and the outer shell to extend in opposite directions 210. As shown in FIG. 2*b*, because of the pulling motion, the actuator element is in an extended position 204, which also causes the connector to be in an extended position 208. The extension of the actuator element 204 also causes the bristles to move longitudinally through the bristle openings 108 to where the bristles are in an extended position 206 protruding through the bristle openings 108 of the outer shell 104. The action of pulling the actuator element to the extended position 204, and then releasing the actuator element from the extended position 204 and allowing it to return the actuator base position 102 shown in FIG. 2*a* and FIG. 1, causes the bristles to move longitudinally back and forth creating a brushing action.

FIG. 3 provides a view of the actuator element with the connector and bristles but without the outer shell 300. As shown in FIG. 3, an embodiment of the actuator element 102 may comprise a flattened top 302, a flattened bottom 304, a thin actuator element front 306, a thin actuator element right side 308, a thin actuator element left side 310, and a thin actuator element rear side 312. The flattened top 302 and flattened bottom 304 may be parallel to each other and separated by a height or the flattened top 302 and flattened bottom 304 may be angled to form a wedge shape. The flattened top 302 and flattened bottom 304 are separated by the front side 306, rear side 312, left side 310, and right side 308. The front side 306 and the rear 312 are parallel to each other and separated by a length. The left side 310 and the right side 308 are parallel to each other and separated by a width. As shown in FIG. 3 and previously discussed in FIG. 1, the actuator element 102 is further comprised of two sections, a handle portion of the actuator 103 and a mouth portion of the actuator element 105. The handle portion of the actuator element 103 comprises approximately the rear two-thirds of the actuator element 102. The mouth portion of the actuator element 105 comprises approximately the front one-third of the actuator element 102, where the mouth portion of the actuator element 105 provides an area for the hollow outer shell (as discussed in FIG. 1) to enclose and provide an enlarged surface area for an animal to bite when biting the outer shell. In the example shown in FIG. 3, the mouth portion of the actuator element 105 is wider than the handle portion of the actuator element 103, however, it should be understood that this description is applicable to any number of configurations of the actuator element 102, including mouth portions of the actuator element that are the same size or thinner than the handle portion of the actuator element 103 as will be understood by one skilled in the art, once they understand the principles of this invention.

As further shown in FIG. 3, four rows of bristles 106 are attached, embedded in or formed to the mouth portion of the actuator element 105. In the example of FIG. 3, the bristles 106 are configured in a saw tooth pattern, however as will be discussed later and as would be understood by one skilled in the art, a variety of bristle configurations may be used with the animal dental cleaning device of the present disclosure. As further shown in FIG. 3, the bristles 106 are arranged in rows with four rows shown in FIG. 3. It should be understood that this description is applicable to any such device with other numbers of bristle rows, as will be understood by one skilled in the art, once they understand the principles of this invention.

The bristles 106 may be made of a variety of suitable materials including, but not limited to, synthetic polymers such as nylon, plastics, such as high density polyethylene 'HDPE', or elastic materials such as styrene-butadiene rubber (SBR), isoprene, butadiene, ethylene-propylene, butyl, chloroprene, nitrile rubber or foam rubber.

FIG. 3 also shows the connector 110. As discussed FIG. 1, the connector 110 is comprised of a rigid rod body that extends or protrudes upwardly from the actuator element 102 to a top cap or mount configured to interface with the outer shell (not shown in FIG. 3) by means of an opening in the outer shell. As previously discussed, the connector 110 provides a rigid attachment point between the actuator element 102 and the outer shell while also allowing the actuator element 102 to slide longitudinally within the outer shell 104 (not shown in FIG. 3), allowing the bristles 106 attached to the actuator element 102 to slide longitudinally within the bristle openings 108 of the outer shell (not shown in FIG. 3).

The actuator element 102 may be made of a variety of suitable rigid materials including, but not limited to, synthetic polymers such as nylon, plastics, such as high density polyethylene 'HDPE', metals including titanium, steel, stainless steel, aluminum, and aircraft aluminum, or composite materials, such as carbon-fiber-reinforced polymers, carbon-fiber-reinforced plastics and carbon-fiber reinforced thermoplastics.

Figure 4:
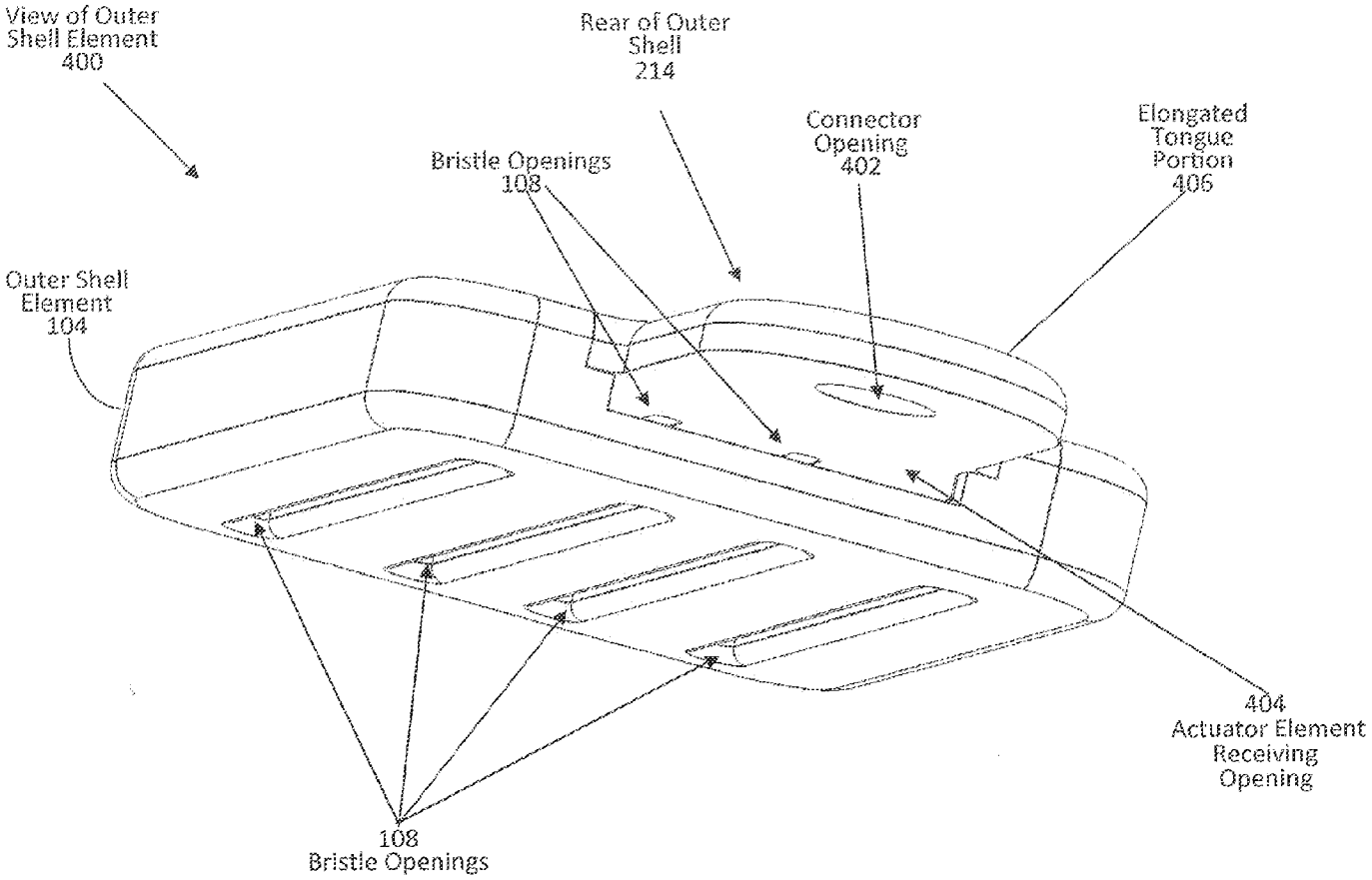
FIG. 4 is a perspective view of the outer shell element of the present disclosure.

FIG. 4 provides a view of the outer shell of the animal dental cleaning device 400. As shown in FIG. 4, the outer shell 104 is a hollow element of the animal dental cleaning device that encompasses the mouth portion of the actuator element (shown as 105 of FIG. 1 and FIG. 3). The outer shell 104 provides a stable area for an animal to bite while allowing the actuator element (not shown in FIG. 4) to move within the outer shell 104. An embodiment of the outer shell 104 may comprise a top, a bottom, front side, right side, left side, and rear side, all of which correspond with the dimensions of the mouth portion of the mouth portion of the actuator element, which allows the outer shell to encompass the mouth portion of the actuator element.

Elongated bristle openings 108 are located on both the flattened top and bottom portions of the outer shell 104. The bristle openings 108 correspond to the location of the one or more rows of bristles (106 for FIGS. 1 and 3) attached to the actuator element. The bristle openings 108 of the outer shell 104 allow for the bristles on the actuator element to protrude through the outer shell 104 and make contact with an animal's teeth.

An opening located at the rear of the outer shell 214, the actuator element receiving opening 404, provides a location where the handle section of the actuator element is located outside of the outer shell 104 and provides an access point for the assembly of the actuator with the outer shell. This actuator element receiving opening 404 provides a separation point between the mouth portion of the actuator element and the handle portion of the actuator element, allowing a person to grasp the handle and pull the actuator element to the extended position, as described in FIG. 2*b*.

As shown in FIG. 4, an embodiment of the outer shell may further comprise an elongated section, called the elongated tongue 406, which protrudes from the rear of the outer shell 214. The elongated tongue 406 forms a section of the outer shell 104 that extends out over the handle portion of the actuator element. The elongated tongue 406 comprises a connector opening 402, which is designed to allow the connector of FIG. 1 and FIG. 3 to extend upwardly through the outer shell 104, to allow the top portion of the connector to interface with the outer shell 104 and connecting the actuator element to the outer shell 104.

The outer shell 104 may be made of a variety of suitable elastic materials including, but are not limited to, styrene-butadiene rubber (SBR). Other suitable materials may include isoprene, butadiene, ethylene-propylene, butyl, chloroprene and nitrile rubber. Other engineered or composite materials may also be used.

Figures 5A, 5B, 5C, 5D, 5E, 5F:
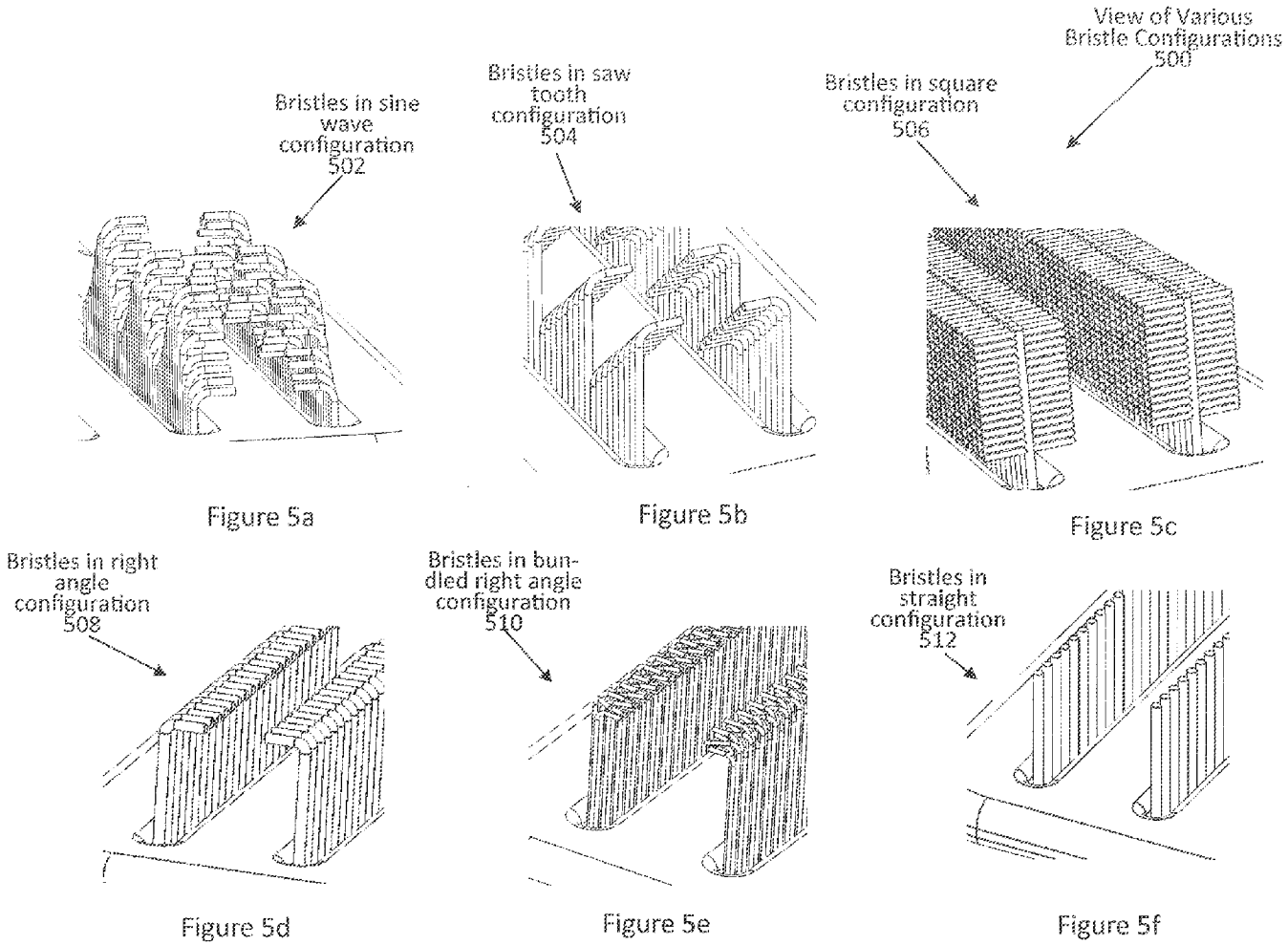
FIG. 5*a* shows an example of the bristles of the present disclosure in a sine wave configuration.
FIG. 5*b* shows an example of the bristles of the present disclosure in a saw tooth configuration.
FIG. 5*c* shows an example of the bristles of the present disclosure in a feather or square configuration.
FIG. 5*d* shows an example of the bristles of the present disclosure in a right angle configuration.
FIG. 5*e* shows an example of the bristles of the present disclosure in a bundle of right angles.
FIG. 5*f* shows an example of the bristles of the present disclosure in a straight bristle configuration.

FIG. 5*a* provides an example configuration of the bristles of the present disclosure 500. As shown in FIG. 5*a*, the bristles are in a sine wave configuration 502. The sine wave configuration 502 comprises at least two rows of bristles with enough space between the rows to allow teeth to fit between the rows. In the sine wave configuration 502, the bristles are of varying lengths and are bent at a 90° angle. This allows the bristles to make contact with the animal's teeth at various locations on the tooth.

In FIG. 5*b*, the bristles are in a saw tooth configuration 504. The saw tooth configuration 504 again comprises at least two rows of bristles with enough space between the rows to allow teeth to fit between the rows. In the saw tooth configuration 504, the bristles again are of varying lengths and are bent at a 90° angle. This allows the bristles to contact with the animal's teeth at various locations on the tooth.

In FIG. 5*c*, the bristles are in a square or feather configuration 506. The square or feather configuration 506 comprises a main center bristle with a plurality of bristles extending 90° from the main center bristle. This configuration allows each individual bristle to contact with a large area of the animal's teeth.

In FIG. 5*d*, the bristles are in a right angle configuration 508. The right angle configuration again comprises at least two rows of bristles with enough space between the rows to allow teeth to fit between the rows. In the right angle configuration 508, the bristles of a length with the top section of the bristle bent at a 90° angle. This allows the bristles to consistently contact with the animal's gum line.

In FIG. 5*e*, the bristles are in a bundled right angle configuration 510. The bundled right angle configuration 510 again comprises at least two rows of bristles with enough space between the rows to allow teeth to fit between the rows. In the bundled right angle configuration 510, the bristles of a length with the top section of the bristle bent at a 90° angle however, the head of the bristle are angles to the right or left.

In FIG. 5*f*, the bristles are in a straight configuration 512. The straight bristle configuration 512 again comprises at least two rows of bristles with enough space between the rows to allow teeth to fit between the rows.

Figure 6:
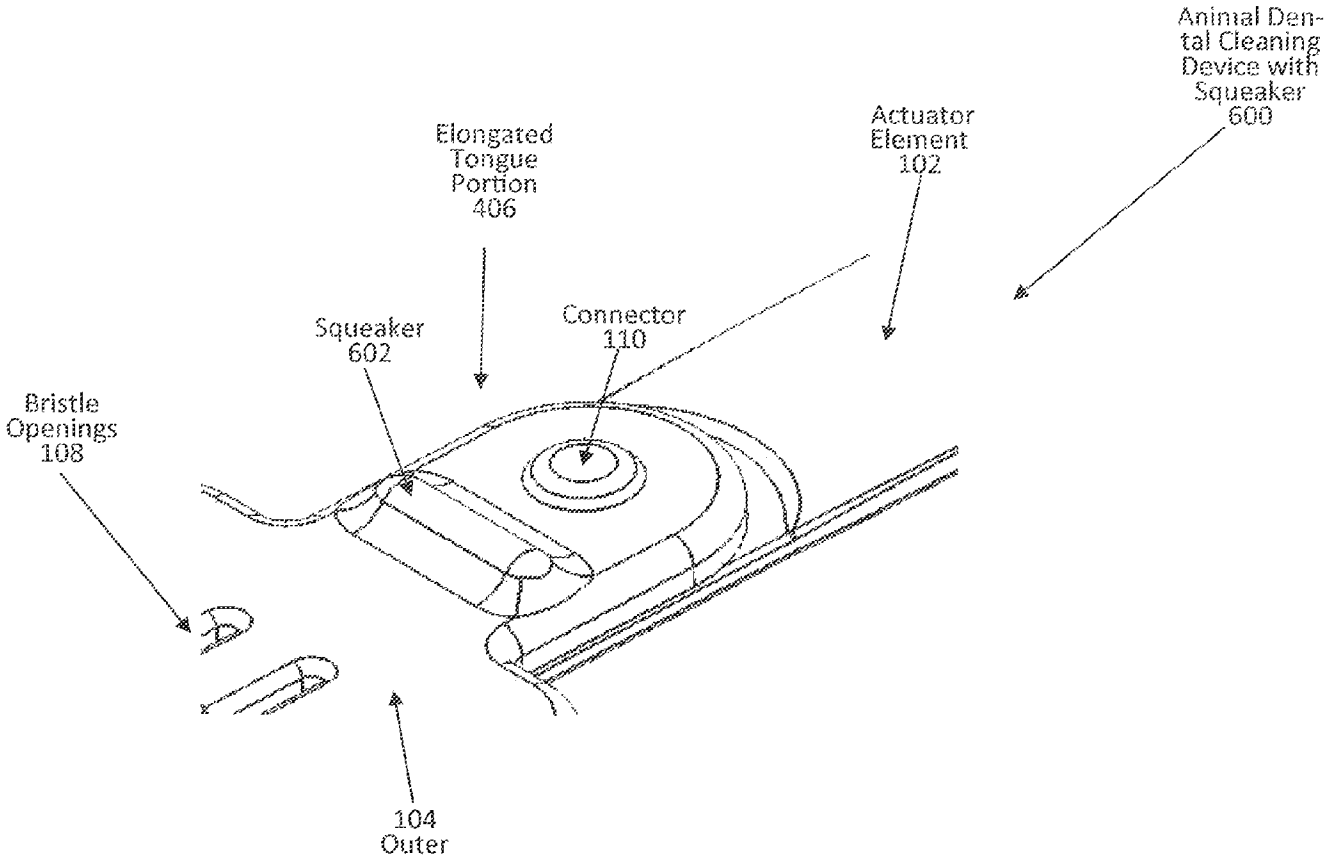
FIG. 6 is a view of a squeaker of an animal dental cleaning device.

FIG. 6 provides an example of squeaker embodiment added to the animal dental cleaning device 600. As shown in FIG. 6, the squeaker device 602 is located on the elongated tongue portion 406 of the outer shell 104. In this example, the squeaker is located between the bristle openings 108 and the connector 110 of the actuator element 102. The squeaker device 602 provides a noise, such as a chirp, when the animal bites the outer shell 104 or when the actuator element 102 is extended. The noise produced by the squeaker is designed to induce an instinctual reaction in the animal biting the outer shell 104 of the animal dental cleaning device 600, inducing or encouraging the animal to pull on the animal dental cleaning device 600, and causing the bristles of the device 600 to brush the teeth of the animal. A variety of squeaker elements may be used with the present disclosure and may be located on a variety of areas of the animal dental cleaning device, including the handle of the actuator element or the outer shell, as will be understood by one of ordinary skill in the art.

Figure 7:
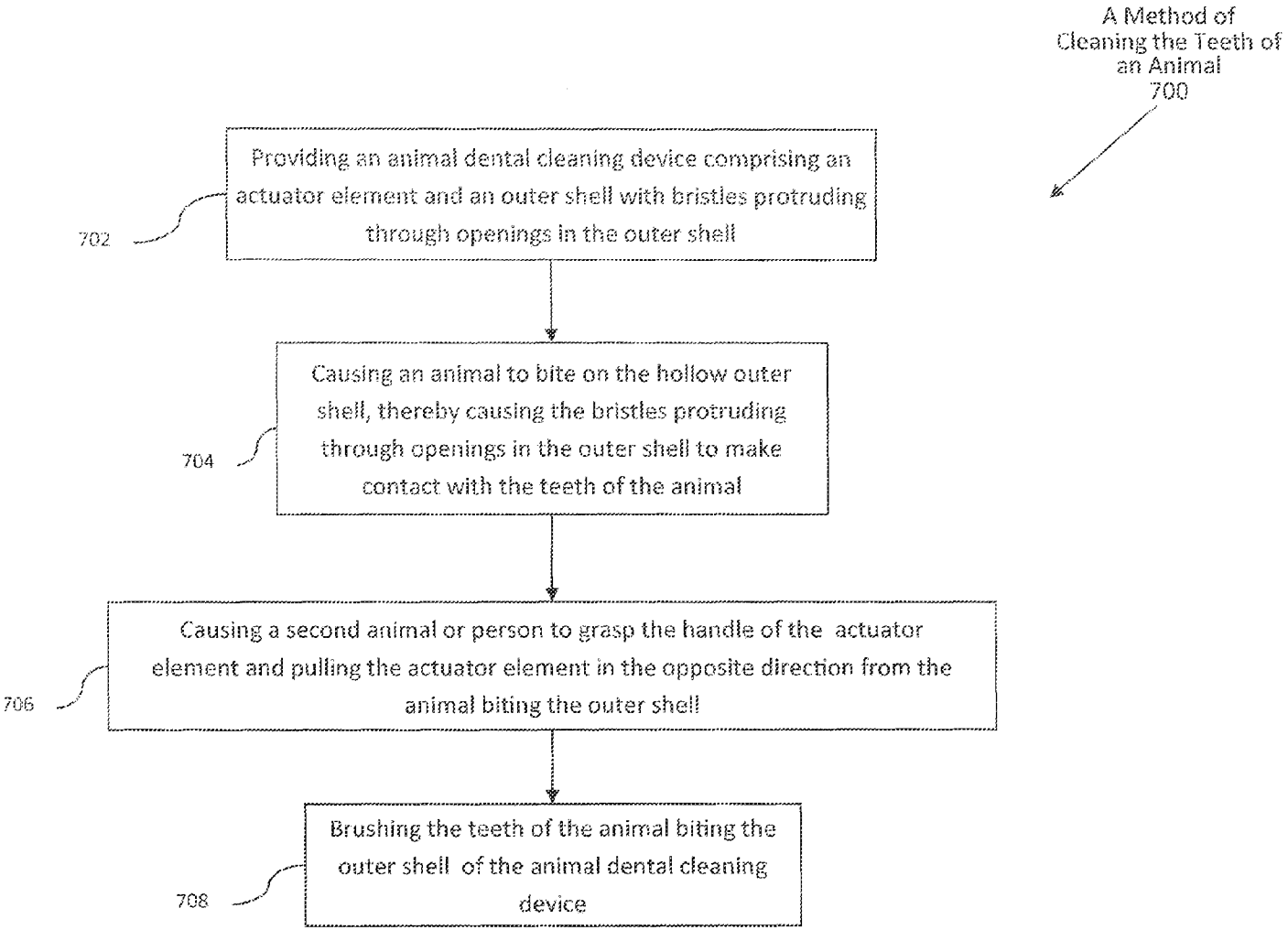
FIG. 7 is a flow diagram showing a method of cleaning the teeth of an animal.

As shown in FIG. 7, a flow chart showing a method of cleaning an animal's teeth, is provided 700. In step 702, an animal dental cleaning device, is provided, where the device comprises an actuator element and an outer shell, where bristles inserted in holes in the mouth portion of the actuator element protrude through openings in the outer shell, as described in FIGS. 1-5 above. In step 704, an animal bites on the hollow outer shell surrounding the actuator element. The biting of the outer shell causes the bristles protruding through the bristle openings in the outer shell to make contact with the teeth of the animal. In step 706, another animal or a human grasps the handle portion of the actuator element and then pulls on the handle in the opposite direction of the outer shell. This action of pulling the handle portion in the opposite direction of the outer shell causes the actuator element to extend away from the outer shell and causes the bristles protruding through the bristle openings to move longitudinally in the direction of the handle portion of the actuator element. Once the second animal or person stops pulling on the actuator element, the actuator element returns to the base or non-extended position of the animal dental cleaning device, causing the bristles protruding through the bristle openings to move longitudinally to their original or base position. In step 708, the movement of the bristles longitudinally back and forth within the bristle openings of the outer shell brushes the teeth of the animal biting the outer shell of the animal dental cleaning device.

The various forms of the animal dental cleaning device embodying the present invention described hereinabove remove plaque, tartar and other debris, which forms on the teeth of animals. The animal dental cleaning device of the present invention also provides the added benefit of entertainment for one or more animals.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An animal dental cleaning device, comprising:

an actuator element handle, wherein said actuator element handle has a surface;

at least one row of a first set of bristles attached to the actuator element handle, wherein the first set of bristles extend in a first direction from the actuator element handle;

at least one row of a second set of bristles attached to the actuator element handle, wherein the second set of bristles extend in a second direction from the actuator element handle;

a connector, wherein said connector extends from the surface of said actuator element handle;

an outer shell, adapted to receive said actuator element handle, said outer shell comprising:

at least one first bristle opening through which said first set of bristles of the actuator element handle extend;

at least one second bristle opening through which said second set of bristles of the actuator element handle extend; and a connector opening;

wherein the actuator element handle is operably coupled to said outer shell by the connector extending through the connector opening, allowing movement of the actuator element handle relative to the outer shell, allowing the first set of bristles and the second set of bristles to move within the first bristle opening and the second bristle opening of the outer shell.

2. The device of claim 1, wherein the direction of the at least one row of a first set of bristles extending in a first direction through the at least one first bristle opening from the actuator element handle is opposite of the direction of the at least one row of a second set of bristles extending through the at least one second bristle opening in a second direction from the actuator element handle.

3. The device of claim 2, wherein the at least one row of a first set of bristles extending in a first direction extend at a 90° angle from the actuator element handle.

4. The device of claim 3, wherein said at least one row of a second set of bristles extending in a second direction extend 180° degrees in the opposite direction from the one row of the first set of bristles extending in a first direction.

5. The device of claim 1, wherein the at least one row of the first set of bristles extending in a first direction from the actuator element handle and the at least one row of the second set of bristles extending in a second direction from the actuator element are configured in a formation consisting of a sine wave, saw tooth, feather, right angle, straight or right angle bundle.

6. The device of claim 5, wherein the actuator element handle is composed of a rigid material.

7. The device of claim 6, wherein the rigid material is chosen from the group comprising synthetic polymers, plastics, metals, and composite materials.

8. The device of claim 1, wherein the outer shell is composed of an elastic material.

9. The device of claim 8, wherein the elastic material is chosen from styrene-butadiene rubber (SBR) isoprene, butadiene, ethylene-propylene, butyl, chloroprene and nitrile rubber.

10. The device of claim 1, wherein the first set of bristles and the second set of bristles are composed of a material chosen from synthetic polymers, plastics, and elastic materials.

11. The devise of claim 1, wherein said connector is composed of an elastic material.

12. A method of cleaning the teeth of an animal comprising:

providing an animal dental cleaning device comprising an actuator element handle and an outer shell, wherein said outer shell is adapted to receive said actuator element handle;

wherein said actuator element handle has a surface with a connector;

wherein said connector extends from the surface of said actuator element handle; and wherein said actuator element handle has at least one row of a first set of bristles attached to the actuator element handle and at least one row of a second set of bristles attached to the actuator element handle;

wherein the first set of bristles extend in a first direction from the actuator element handle; and wherein at least one row of a second set of bristles attached to the actuator element handle, wherein the second set of bristles extend in a second direction from the actuator element handle;

wherein said outer shell has at least one first bristle opening, through which said first set of bristles of the actuator element handle extend and at least one second bristle opening, through which said second set of bristles of the actuator element handle extend;

wherein the actuator element handle is operably coupled to said outer shell by the elastic connector extending through the connector opening;

causing an animal to bite on the outer shell of the animal dental cleaning device, thereby causing the bristles to contact the teeth of the animal;

moving the actuator element handle relative to the outer shell; and brushing the teeth of the animal by allowing the first set of bristles and the second set of bristles to move within the first bristle opening and the second bristle opening of the outer shell.

13. The method of claim 12, further comprising:

causing the actuator element handle to move to a base position relative to the outer shell.

14. The method of claim 13, wherein the movement of the actuator element handle relative to the outer shell, allows the first set of bristles and the second set of bristles to move within the first bristle opening and the second bristle opening, brushing the teeth of the animal biting the outer shell of the animal dental cleaning device.

15. The method of claim 12, the movement of the actuator element handle relative to the outer shell is caused by a second animal or human pulling on the actuator element handle.

16. The method of claim 12, wherein said connector is composed of an elastic material.

* * * * *